United States Patent [19]

Spanel et al.

[11] 4,064,816

[45] Dec. 27, 1977

[54] DOUBLE SELECT NEEDLE TUFTING MACHINE

[75] Inventors: Abram N. Spanel, Princeton, N.J.; P. Frank Eiland, Stamford; David R. Jacobs, New Canaan, both of Conn.

[73] Assignee: Abram N. Spanel, Princeton, N.J.

[21] Appl. No.: 700,413

[22] Filed: June 25, 1976

[51] Int. Cl.[2] ..... D05C 15/16

[52] U.S. Cl. ..... 112/79 A; 112/221

[58] Field of Search ..... 112/79 A, 79 R, 79.5, 112/79 FF, 78, 221, 219 A; 139/449, 446

[56] References Cited

U.S. PATENT DOCUMENTS

| | | | |
|---|---|---|---|
| 2,522,582 | 9/1950 | Newman | 112/221 |
| 3,259,088 | 7/1966 | Rockholt | 112/79 R |
| 3,361,096 | 1/1968 | Watkins | 112/79 R |
| 3,439,638 | 4/1969 | Zuk | 112/219 A |
| 3,678,968 | 7/1972 | Juillard | 139/446 |

*Primary Examiner*—H. Hampton Hunter

*Attorney, Agent, or Firm*—J. Rodman Steele, Jr.

[57] ABSTRACT

A double select needle tufting machine or the like utilizing a driving and selecting means comprising band-like members attached to each of said needles with each band-like member being selectively engageable with an oscillatory shaft by which each of the needles is driven when selected. Two-color carpets or bedspreads are produced by threading one series of needles with one color yarn and the other series of needles with a second color of yarn.

7 Claims, 12 Drawing Figures

24
120
39
114
25
41
120
114
122
30
20
14
32
22
16
34
38
100B
100A
100
68
12
36
40
68
13

102B
102A
102
78
78
74
74
70
80
80
82
84
10
76
76
72
82
84
86

Fig 2
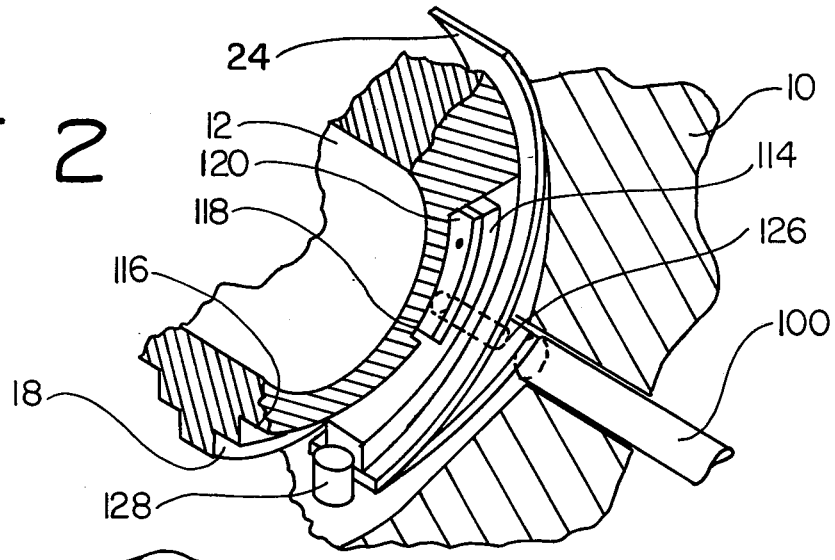
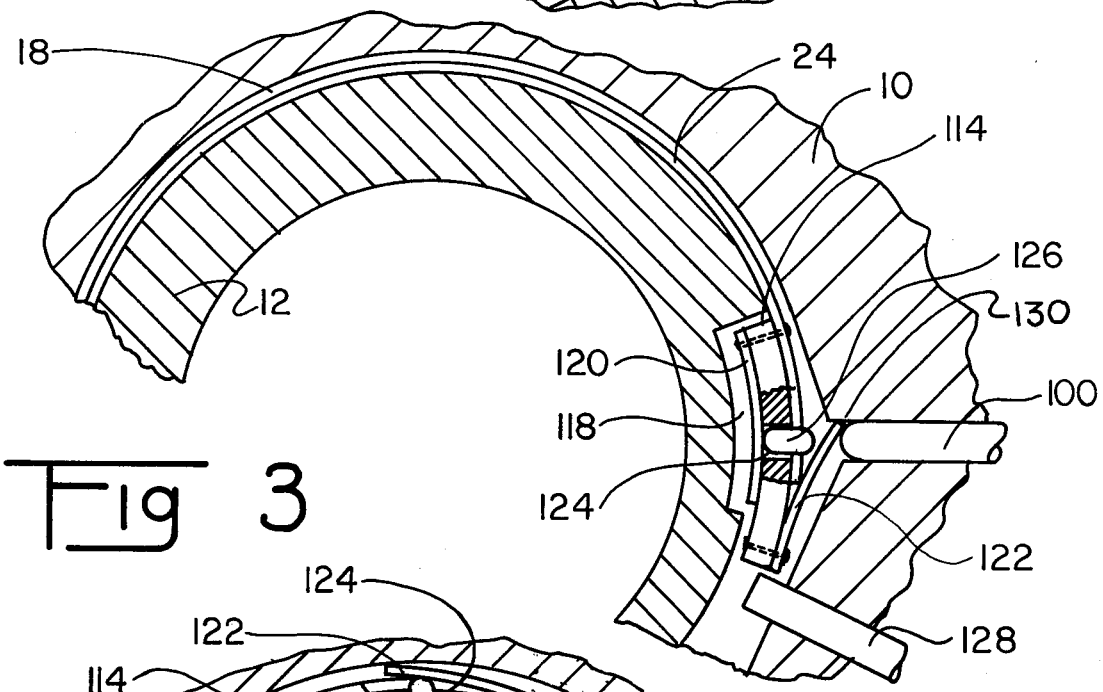
Fig 3
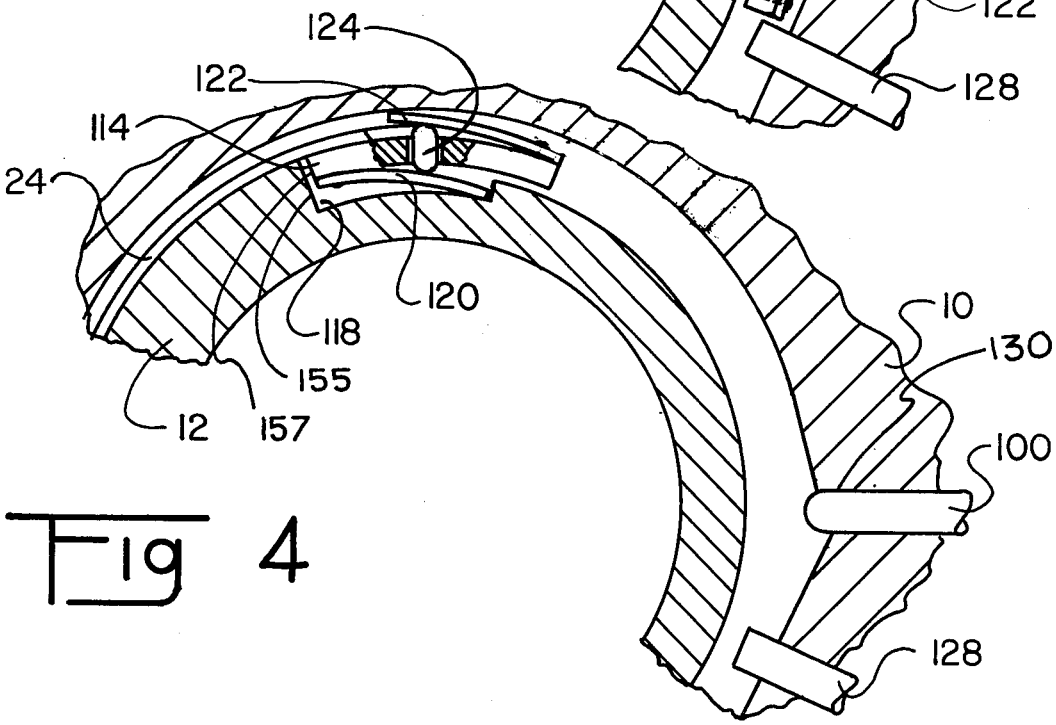
Fig 4

DOUBLE SELECT NEEDLE TUFTING MACHINE

BACKGROUND OF THE INVENTION

The subject double select needle tufting machine has utility in the tufting industry and can be used to make bedspreads, towels and the like as well as pile carpets.

Select needle or control needle machines are known. See, for example, U.S. Pat. Nos. 3,376,835 and 3,361,096. Such machines have been used primarily to manufacture bedspreads and terry-like fabrics; however, the use of such machines in the tufting carpet industry is also known. While conventional tufting machines characteristically have a single row of needles, double select needle tufting machines have two sets of needles and tufting can be carried out by patterning as, for example, leaving non-tufted areas as well as tufted areas by not selecting a needle and, also, by supplying different series of needles with different colors so that two-color carpets or bedspreads may be tufted. Needle bar structure for such machines is massive and driving and selecting means for this type of machine is similar to that of most conventional tufting machines.

In addition to the subject disclosure, copending Application Serial Nos. 699,904, 699,906, and 699,905 contain related subject matter.

SUMMARY OF THE INVENTION

In accordance with the subject invention, a standard double select needle tufting machine of conventional nature may be used; however, a modified needle arrangement together with needle selection and driving means forms the basis of the subject invention. It is the principal object of the subject invention to provide an improved needle arrangement which can utilize improved selection and drive means and operate with far greater efficiency than heretofore known machines. Mechanisms below the backing layer, such as the hook and knife combination, and backing transport means, may be conventional.

While the use of two needles is discussed throughout for each tufting station, it will be appreciated that by using various off-set methods, four colors could actually be incorporated into a pattern.

The needle arrangement comprises the use of two needles at each needle station inclined to one another, so as to both travel to essentially the same location where the backing layer will be penetrated upon reciprocation. Band-like members or ribbons, preferably constructed of steel, are attached to each of the needles and the bands are channelized so as to slide when subjected to compression forces. The band-like members are housed in stationary channels as they extend from needles until they reach curvilinear channels comprised of stationary housing structure and grooves in oscillating shafts. The band-like members extend around a portion of one of the shafts and are engageable with the shafts by means of an engaging mechanism at the terminus of each band-like member. Solenoid plungers which are responsive to signals from solenoids, cause the engaging mechanism of the band-like members to be driven into an engagement with the shafts, upon selection, at which time the band-like members serve to drive their respective needles, thereby producing the pile tuft.

Once a particular needle has been selected, that needle will reciprocate until the solenoid is deactuated, causing the driving band-like member to be disengaged from its respective oscillating shaft.

BRIEF DESCRIPTION OF THE DRAWINGS

FIG. 2 is an isometric cut-away view showing an oscillatory member and band actuation structure;

FIG. 3 is a cross-sectional plan view of the mechanism of FIG. 2 with a solenoid plunger in a deactuation position;

FIG. 4 is a cross-sectional plan view of the mechanism of FIG. 2 with a solenoid plunger shown in its actuation position;

DETAILED DESCRIPTION

Figure 1:
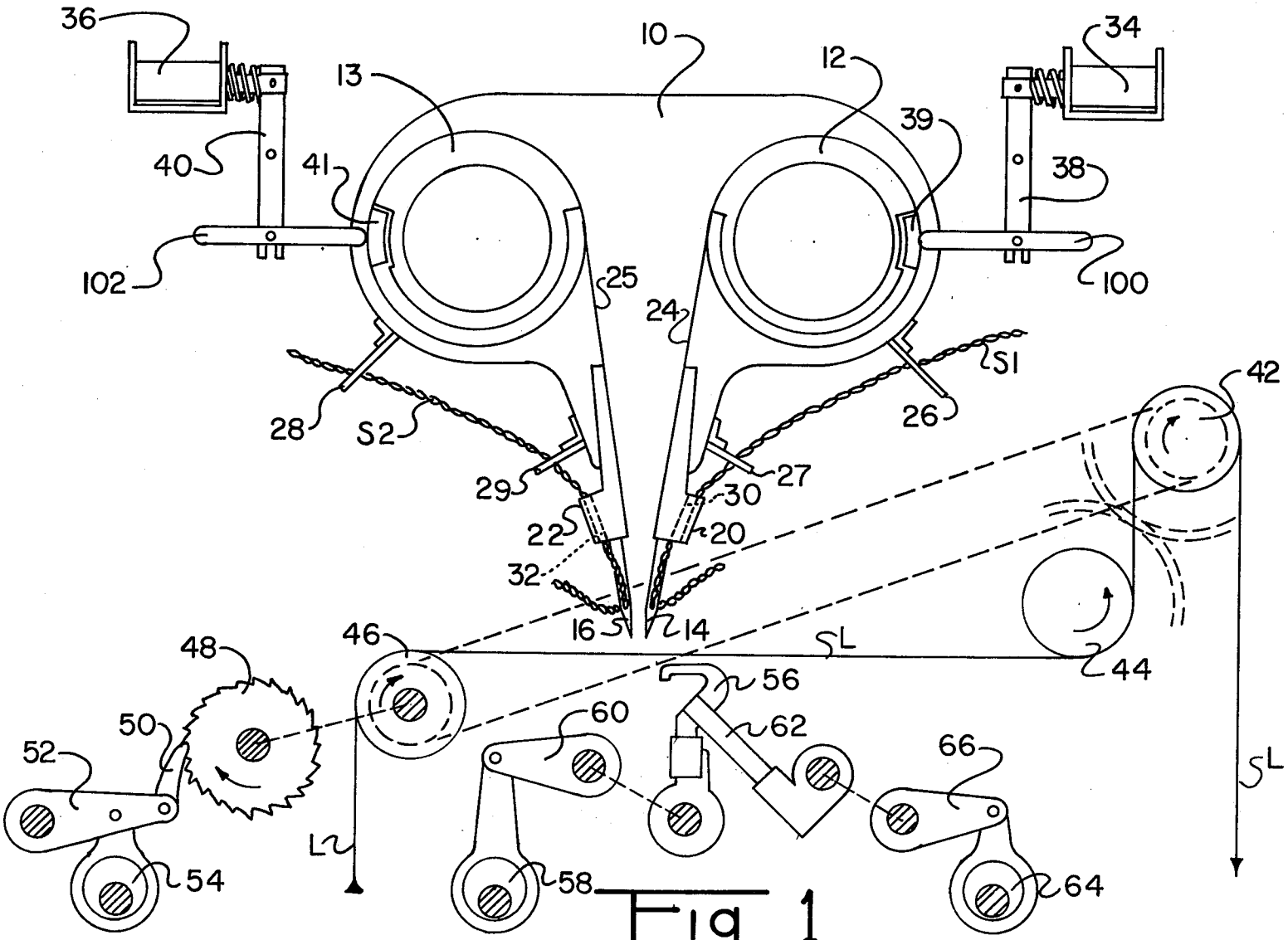
FIG. 1 is a schematic plan view showing the double select needle tufting machine.

With reference to FIG. 1, housing 10 houses the needle drive and selection structure. Oscillatory shafts 12 and 13 are shown with band-like members or ribbons 24 and 25 extending therefrom to needles 14 and 16. The bands or steel ribbons 24 and 25 terminate at or along the upper head portions 20 and 22, respectively, of the needles 14 and 16. The upper head portions 20 and 22 may be integral with needles 14 and 16 or they may be members into which needles 14 and 16 are inserted or otherwise secured. The yarn strands S1 and S2 extend from creels (not shown) and are guided by yarn guides 26 and 27 for S1 and 28 and 29 for S2. The yarn strands S1 and S2 also feed through bore guides 30 and 32 which contain one way clamps (dogs) and extend through the upper head portions 20 and 22, respectively. The one way clamps serve to prevent the yarn from being pulled from the needle eyes once threaded.

Solenoids 34 and 36 provide the selection means for the tufting unit and when solenoid 34 is actuated, band 24 becomes engaged with oscillatory shaft 12 so that needle 14 is driven and when solenoid 36 is actuated, band 25 becomes engaged with oscillatory shaft 13 so that needle 16 is driven. Intermediate linkage 38 and 40 extends to solenoid plungers 100 and 102, respectively, from solenoids 34 and 36. The engaging mechanisms 39 and 41 are shown schematically and are associated with the ends of the bands 24 and 25, respectively. These mechanisms are shown in FIGS. 2–4 and will be described subsequently in detail.

With further reference to FIG. 1, a backing layer L, into which yarn is tufted, is fed to doff roll 42 over backing feed roll 44 from feed roll 46. Feed roll 46 is driven by the ratchet 48 and pawl 50 drive which is controlled through linkage 52 by eccentric 54. A standard type of looper 56 is positioned below the backing layer and is driven by eccentric 58 through linkage 60. The knife means 62, also standard, is associated with the looper and is driven by eccentric 64 through linkage 66.

While not shown, it is to be understood that a motor, through suitable transmission apparatus, will drive the various drive mechanisms such as eccentrics 54, 58 and 64, as well as the drive mechanisms for shafts 12 and 13. The solenoids 34 and 36 receive control signals for selective actuation of the needles 14 and 16. Pattern information such as recorded on tape, drums or other medium is converted into electrical or other type signals which are then transmitted to the solenoids 34 and 36 in synchronism with the operation of the machine.

Figures 1A, 1B, 1C:
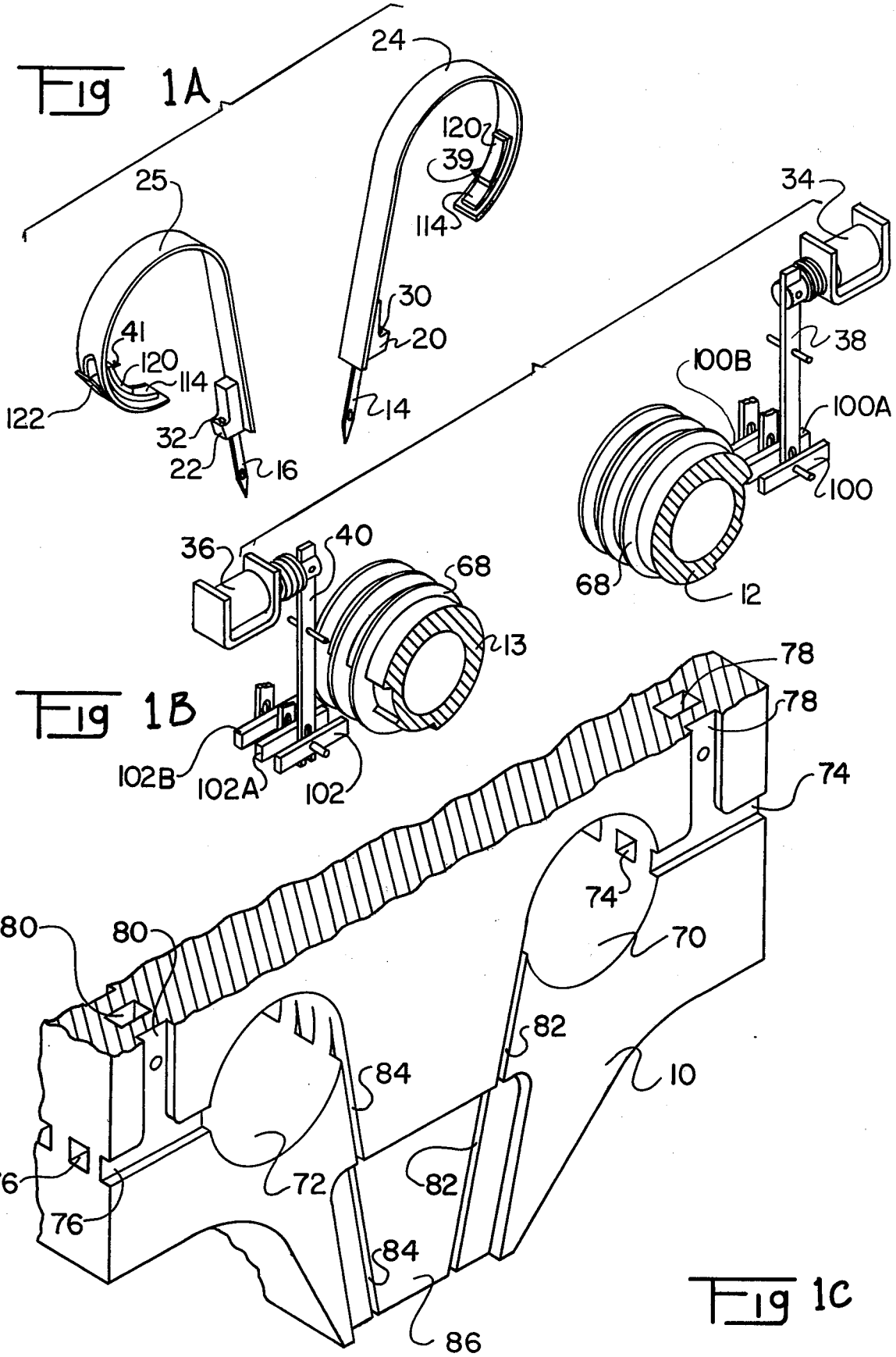
FIG. 1A is an isometric view showing the needles together with their driving bands.
FIG. 1B is an isometric view of the needle drive shafts and the actuating solenoids.
FIG. 1C is an isometric view of the needle drive and selection mechanism housing.

With reference to FIG. 1A, bands 24 and 25 are shown in isometric views and are shown attached to the upper head portions 20 and 22 of needles 14 and 16, respectively. As stated previously, needles 14 and 16 can be independent shank members which are not integral with the upper structure but are held in place by fastening structure (not shown) to members 20 and 22 which could also serve as holders as well as being the upper head portions of the needle structure. The engaging mechanisms 39 and 41 will be discussed in detail when FIGS. 2–4 are reviewed.

With reference to FIG. 1B, shafts 12 and 13 are shown in isometric views together with each respective solenoid actuation unit comprising solenoids 34 and 36. It will be noted that each of the shafts 12 and 13 runs continuously width-wise across the machine and that the shafts 12 and 13 oscillate continually during the operation of the machine. Structure 68 serves as a dividing means between each different unit and it will be noted that a series of plungers 100, 100A and 100B, as well as 102, 102A and 102B, serve each of the separate units, each of which corresponds to a needle station: i.e., each needle station has two needles 14 and 16 which are independently actuated by plungers 100 and 102 which comprise a single tufting station. The next succeeding tufting station for the next series of needles 14 and 16 would be controlled independently by plungers 100A and 102A, respectively. Plungers 100A and 102A are actuated by independent solenoids (not shown).

With reference to FIG. 1C, a portion of the housing 10 is shown. In particular, cavities 70 and 72 house shafts 12 and 13, respectively. Plungers 100 and 102 are housed in cavities 74 and 76, respectively, and upright linkage members 38 and 40 are housed in vertical cavities 78 and 80, respectively. Bearing slots 82 and 84 extend into the unit housing 10 and the guide bands 24 and 25, respectively, so that they will not bend when subjected to compressive forces. It will be noted that the housing is cut-away to form cavity-like area 86 above the needles which permits the needles and their upper head portions 20 and 22 to reciprocate within the general confines of housing 10 so that the bands 24 and 25 may remain secured within slots 82 and 84, respectively.

With reference to FIGS. 2–4, views of the mechanisms which cause the engagement of bands 24 and 25 with oscillating drive shafts or tubes 12 and 13 are shown. Only band 24 and shaft 12 are shown; however, it will be understood that identical structure may be utilized for band 25 and shaft 13. The band or ribbon such as 24 is contained in channel 18 and while it may slide, it will not bend when subjected to compression forces. As will be recalled from FIG. 1, the band or ribbon 24 extends to upper head portion 20 of needle 14 where it is soldered, welded or otherwise secured. The band or ribbon 24 extends from this upper head portion 20 around the shaft 12 for approximately 180° and terminates in a shoe 114. As can best be seen from FIG. 2, shaft 12 closely fits within the cavity formed in housing 10 and groove 18 which carries band 24 is actually the shallowest of three grooves or notches in shaft 12. An intermediate groove 116 which extends partially around the shaft supports shoe 114. A third deeper notch or groove 118 has a purpose which will be described subsequently.

The shoe 114 may be welded, soldered or otherwise attached to band or ribbon 24. A drive spring 120 is welded, soldered or otherwise attached to the base of shoe 114 and extends along part of the distance of shoe 114. It will be noted that the ribbon or band 24 has a portion of its center cut out to give a lanced tab 122. See also FIG. 1A where similar structure is shown on band 25. The shoe 114 has a cavity 124 in which is contained a compressible spring 126 which bears against drive spring 120 and which extends through the lanced out portion of band or ribbon 24. A stop member 128 is rigidly secured to and embedded within housing structure 10. The left tip of actuation pin 100 is shown in its non-energized position in FIGS. 2 and 3. When plunger or actuation pin 100 is as shown in FIGS. 2 and 3, the ribbon or band 24 is held out of action due to the interference of lanced out tab 122 with surface 130 of housing 10. The band or ribbon 24 is prevented from being driven in a clockwise direction by stop member 128 as can be seen in FIGS. 2 and 3.

When a needle, such as 14, is to be selected and hence the band or ribbon 24 of that unit is to be actuated, the plunger or actuation pin 100 is advanced, thus unlatching spring 122 from surface 130. As spring 122 is unlatched, it applies pressure to the compressible pin 126 which, in turn, depresses the drive spring 120. As can be seen best in FIG. 3, the drive spring 120 is attached to only one end of shoe 114 and thus can be driven outwardly from the shoe by compressible pin 126 as permitted by the shaft 12 structure. As the shaft oscillates, it will reach the position as shown in FIG. 3 at which time the compressible pin 126 will force the lower end of drive spring 120 into engagement with notch 118. As the shaft 12 reverses, drive spring 120 will be driven in the counterclockwise direction, thus driving band member 24. As the band or ribbon 24 advances and the lanced out portion or tab 122 of the ribbon or band 24 becomes trapped within groove 18 formed between the shaft and the stationary housing 10 (as seen in FIG. 4), the drive spring 120 will be held in its drive position. Thus, as can be seen in FIG. 4, the band or ribbon 24 is driven as far as the oscillatory motion of the shaft carries it since the drive spring 120 is engaged in the driving or deepest notch 118. As this counterclockwise motion of band 24 occurs, it will be appreciated that needle 14 of FIG. 1 is driven downwardly to penetrate the backing layer and deposit tufts therein.

As the shaft 12 oscillates in a clockwise direction, surface 155 of shaft 12 engages surface 157 of shoe 114 whereby band 24 will be returned to its unactuated position and if actuation pin 100 has been deactivated by the solenoid means, then the lanced out tab 122 will be permitted to return to its position where it abuts against surface 130 and compressible pin 126 will be permitted to release its pressure against drive spring 120 which will return to its non-driving position in juxtaposition against shoe 114 and out of engagement with notch 118. Thus, as the shaft 12 oscillates in a counterclockwise direction, the next time the band 24 will remain in its stationary non-actuated position. On the other hand, if the same needle is to be used for a second time in succession, the solenoid is left actuated and the actuation pin or plunger 100 remains in the position as shown in FIG. 4 thus causing the band 24 to be driven by oscillating shaft 12 for as many cycles as desired.

Figure 5:
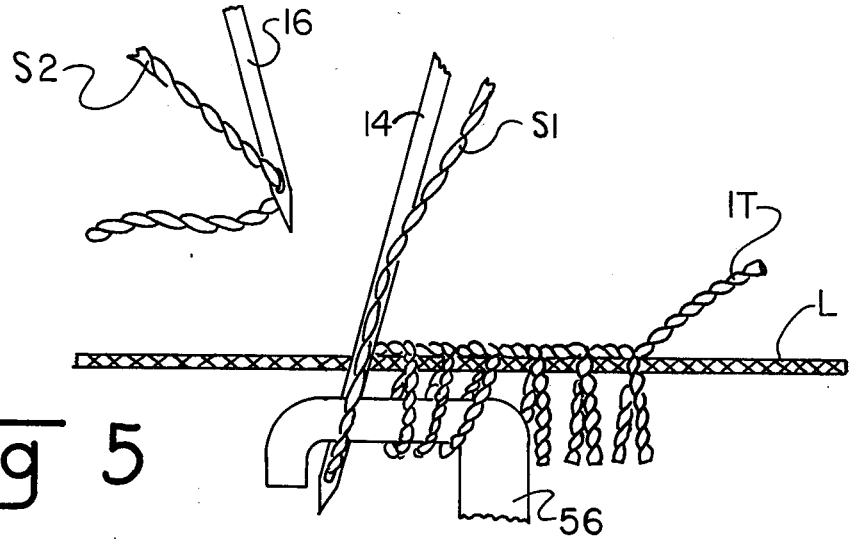
FIG. 5 is a plan view of the needles showing the right-hand needle during a tufting operation.

With reference to FIG. 5, needle 14 is shown penetrating the backing layer L to deposit tufts therein. A selected needle such as 14 will continue to tuft so long as solenoid 34 is in its actuated position causing engaging mechanism 39 to engage band 24 which is driven by shank 12.

It will be noted that as needle 14 tufts yarn strand S1, the tuft loops are formed by looper 56 to enable knife means 62 (see FIG. 1) to sever the loops of yarn in standard fashion to produce cut pile of U-shape configuration. As each tufting sequence begins, i.e., the first stroke of a needle beginning its tufting sequence, a severed strand of yarn or incomplete tuft, IT, is formed. These incomplete tufts, IT, are not of detrimental significance for reasons that will be discussed subsequently and they can be easily removed from the backing layer by vacuum application, brush or other means.

Figure 6:
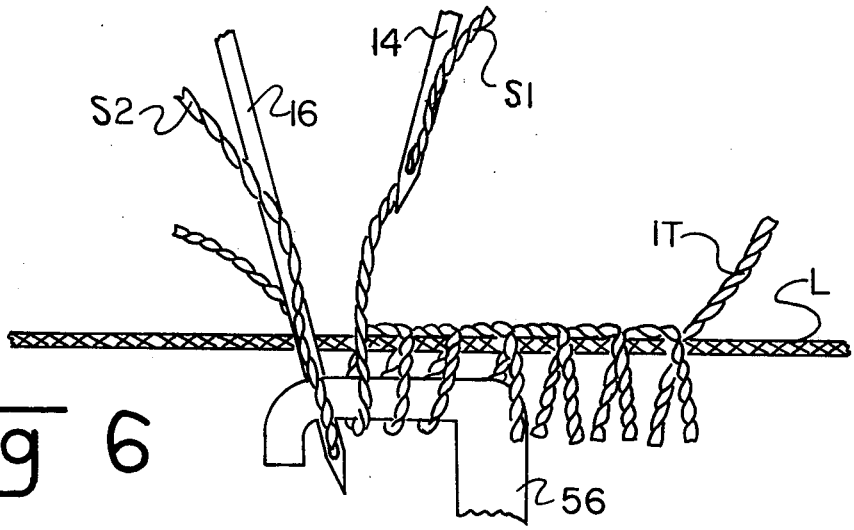
FIG. 6 is a plan view of the tufting needles showing the completion of a tufting sequence by the right-hand needle and the initiation of a tufting sequence by the left-hand needle.

With reference to FIG. 6, it will be seen that needle 14 has withdrawn and at this point has been de-selected by the deenergization of solenoid 34 while needle 16 has been selected by the energization of solenoid 36. Thus, needle 14 has completed its last tufting stroke of the sequence while needle 16, as driven by shaft 13 through band-like member 25, has penetrated the backing layer for the first time to initiate a sequence.

Figure 7:
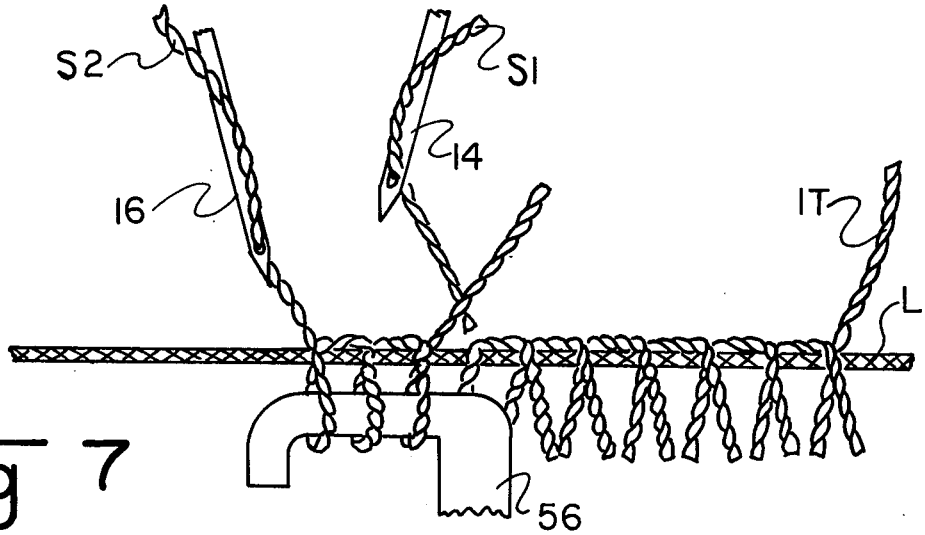
FIG. 7 is a plan view further along in the sequence of the left needle tufting.

With reference to FIG. 7, the needle 16 is shown completing its third penetration which may or may not complete a sequence, depending upon signals from solenoid 36. It will be appreciated that looper 56 operates in conventional manner and knife blade 62 (not shown in the sequence of FIGS. 5–7) will coact to make the cut pile as shown. Once the tufts have been cut, incomplete tufts, IT, as stated above, are of no significance and can be removed from the carpet by vacuum application or other means.

Figure 8:
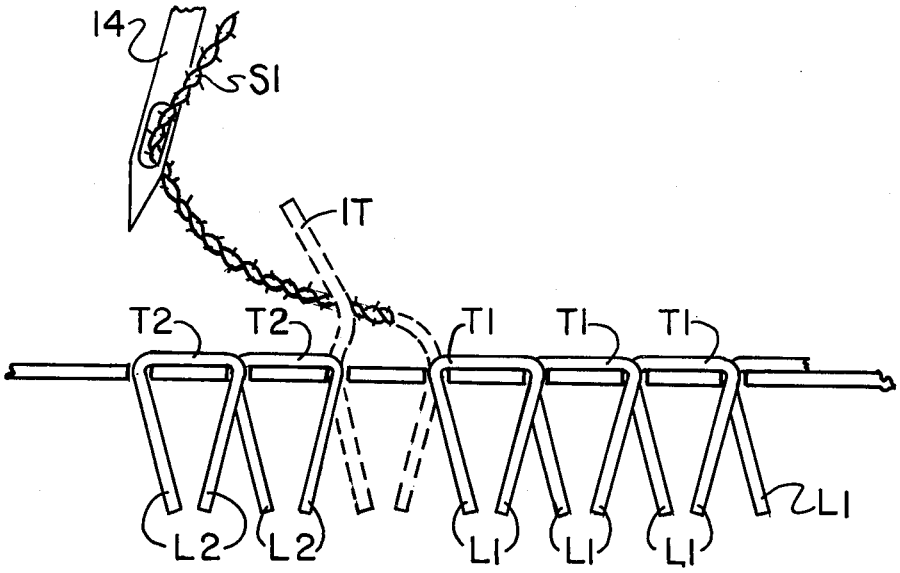
FIG. 8 shows tufts which are tufted by a process as set forth in FIGS. 5–7.

With reference to FIG. 8, the matter of incomplete tufts, IT, is covered. An incomplete tuft, IT, will result every time there is a needle change; however, once this tuft, IT, is removed, the tufts, T1 from needle 14, and tufts T2 from yarn S2 which has been fed by needle 16, will be left. Each of the tufts T1 and T2 is shown having U-shaped legs, L1, which form the pile for the product. As shown in FIG. 8, the dangling portion of strand S1 pulls from the backing layer as a result of yarn tension after the knife 62 makes its cut and the backing layer advances. The yarn S1 remains contained in the needle eye of needle 14, ready for the next penetration of needle 14. Such a tufting technique is completely acceptable and the removal of the incomplete tuft IT is of no real consequence since, if anything, it serves to emphasize the change in color or yarn denier which occurs when needles are changed.

Figure 9:
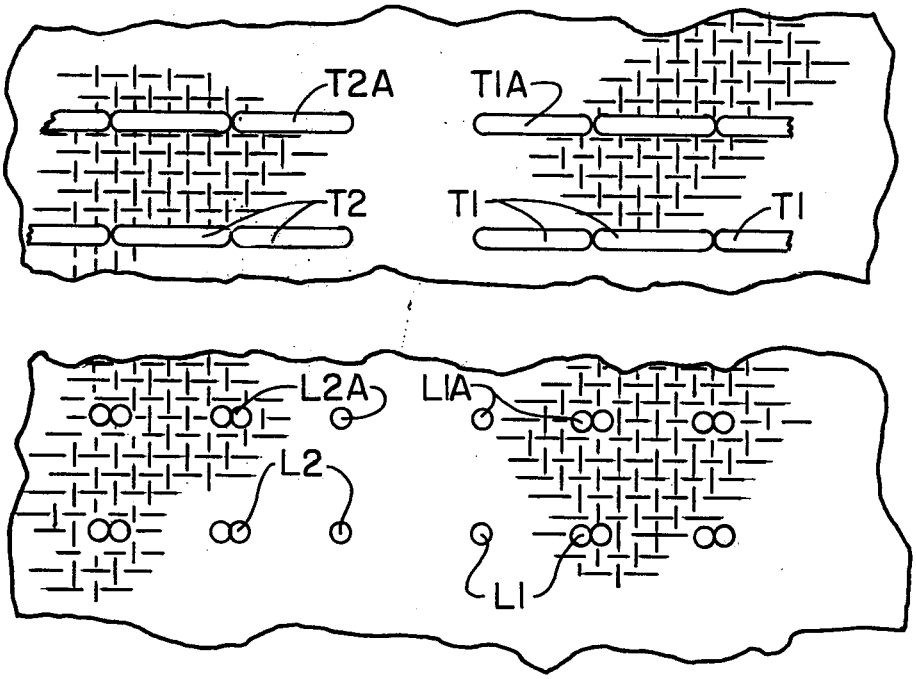
FIG. 9 shows the front and corresponding back side of a carpet which has been tufted by the process shown through FIGS. 5–7.

With reference to FIG. 9, the top portion represents the under side of the backing where the base portion of the U-shaped tufts rests. As shown, yarn portions T1 and T2 are from the needles 14 and 16, respectively, while T1A and T2A represent the tufts which have been embedded by the next series of needles which corresponds to needles 14 and 16. With reference to the lower portion of FIG. 9, tuft legs L1 are from needle 14 while the L2 tufts are from needle 16 as can be seen from FIGS. 5–8. The tuft legs L1A and L2A correspond to tufts L1 and L2 and are from the next series of tufting needles which correspond to needles 14 and 16. As shown in FIG. 9, the needle changes for the needles tufting T1 and T2 versus T1A and T2A have been made at the same time; however, it is to be understood that each needle can be independently actuated and, accordingly, there is no requirement that the needles in succeeding rows switch in unison. In fact, it should be clearly recognized that, particularly in making bedspreads and the like, there may be periods of time when spaces are desired and, accordingly, through certain machine cycles, neither needles 14 nor 16 need be tufting.

Thus, it will be recognized that by using the driving and selecting means above-described, that either or neither needle of each series may be selected to tuft on every cycle.

It will be appreciated that the selection and drive arrangement of the subject disclosure has application for many different types of needle arrangements. For example, a single row of needles may be utilized in which every other needle is threaded differently: i.e., even numbered needles with one color and odd needles with a second color. The colors can be changed, and when the tuft height is sufficiently high, the off-set which will be produced is not detrimental to appearance. In the alternative, double needles may be off-set such as disclosed in FIG. 1, with each of needles 14 and 16 having a different color while the adjacent needles in the next series have two additional colors making a total of four needles which can be effectively used for pattern control.

It should be noted that with respect to the construction of the band-like member and the oscillating shaft, the smaller the shaft is, the thinner the band must be. Since the band should not take permanent deformation, Hook's Law of Stress should not be surpassed. While hardened stainless steel is preferred for the band-like member, plastic bands and other metal bands can be used as well, so long as they do not take permanent deformation. As an example, it has been found that stainless steel bands on the order of 1/100 of an inch in thickness are acceptable for the operations discussed herein using a 5 inch drive shaft.

The present invention may be embodied in other specific forms without departing from the spirit or essential attributes thereof and, accordingly, reference should be made to the appended claims, rather than to the foregoing specification as indicating the scope of the invention.

What is claimed is:

1. A tufting machine or the like including tufting needles for tufting yarn into a backing layer comprising:

an oscillatory member;

flexible band-like members selectively engageable with said oscillatory member and extending to each of said tufting needles; and restraining means forming tracks for said band-like members to enable said band-like members to effectively impart motion without unwanted flexing to said needles.

2. The tufting machine or the like of claim 1 including tufting stations wherein each tufting station comprises two tufting needles, and further including a selection means for controlling each tufting needle.

3. A tufting machine or the like including tufting needles for tufting yarn into a backing layer comprising:

an oscillatory driving member;

structure adjacent said oscillatory member forming a peripheral track around at least a portion of said oscillatory member;

structure forming an extension track from said oscillatory member;

a band-like member, engageable by said oscillatory member and extendable within said extension track to each of said tufting needles; and a means of selectively engaging said band-like members responsive to selection signals.

4. The tufting machine or the like of claim 3 wherein said selection means comprises individual solenoids for each of said band-like members.

5. The tufting machine or the like of claim 3 wherein one of said oscillatory or band-like members has a notch and the other has a protrusion, said apparatus further comprising means of driving said protrusion into said notch to cause said band-like member to be engaged by said oscillatory member.

6. The tufting machine or the like of claim 5 wherein a portion of structure adjacent to said oscillatory member has an abutment and wherein said band-like member includes a portion engageable with said abutment to prevent movement of said band-like member unless actuated.

7. The tufting machine or the like of claim 6 wherein said means of driving said protrusion into said notch serves to drive said engaging portion of said band-like member free from said abutment as said band-like member is engaged by said oscillatory member.

* * * * *

UNITED STATES PATENT OFFICE

CERTIFICATE OF CORRECTION

Patent No. 4,064,816 Dated December 27, 1977

Inventor(s) Abram N. Spanel, P. Frank Eiland and David R. Jacobs

It is certified that error appears in the above-identified patent and that said Letters Patent are hereby corrected as shown below:

Column 3, line 49, delete "the guide" and replace with --guide the--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*